US006672382B2

(12) United States Patent
Schultz et al.

(10) Patent No.: US 6,672,382 B2
(45) Date of Patent: Jan. 6, 2004

(54) DOWNHOLE ELECTRICAL POWER SYSTEM

(75) Inventors: Roger L. Schultz, Aubrey, TX (US); Brock Watson, Carrollton, TX (US); Michael L. Fripp, Carrollton, TX (US); Juanita M. Cassidy, Duncan, OK (US)

(73) Assignee: Halliburton Energy Services, Inc., Dallas, TX (US)

( * ) Notice: Subject to any disclaimer, the term of this patent is extended or adjusted under 35 U.S.C. 154(b) by 77 days.

(21) Appl. No.: 10/142,134

(22) Filed: May 9, 2002

(65) Prior Publication Data

US 2003/0019621 A1 Jan. 30, 2003

(51) Int. Cl.[7] ..... E21B 43/00

(52) U.S. Cl. ..... 166/65.1; 166/248; 324/355; 204/248; 204/228.1; 340/855.8; 367/911

(58) Field of Search ..... 166/65.1, 248; 175/48, 50; 324/355; 204/194, 248, 228.1; 340/853.1, 855.8; 367/911

(56) References Cited

U.S. PATENT DOCUMENTS

| | | | | | |
|---|---|---|---|---|---|
| 2,654,960 | A | | 10/1953 | Hewitt | |
| 3,118,127 | A | * | 1/1964 | Savage | 340/856.4 |
| 3,309,656 | A | * | 3/1967 | Godbey | 367/85 |
| 3,417,371 | A | * | 12/1968 | Sterry | 367/79 |
| 3,596,511 | A | * | 8/1971 | Hart | 73/864.44 |
| 3,876,471 | A | | 4/1975 | Jones | |
| 4,532,614 | A | | 7/1985 | Peppers | |
| 5,091,725 | A | * | 2/1992 | Gard | 340/854.1 |
| 6,148,263 | A | * | 11/2000 | Brooks et al. | 702/6 |
| 6,253,847 | B1 | | 7/2001 | Stephenson | |

FOREIGN PATENT DOCUMENTS

| | | |
|---|---|---|
| WO | WO 01/40620 A1 | 6/2001 |
| WO | WO 01/89014 A1 | 11/2001 |

OTHER PUBLICATIONS

PCT Search Report for International Application No. PCT/US01/23280.

* cited by examiner

*Primary Examiner*—Roger Schoeppel
(74) *Attorney, Agent, or Firm*—Marlin R. Smith

(57) ABSTRACT

A downhole electrical power system provides long term electrical power in a downhole environment. In a described embodiment, a downhole electrical power system includes a power source which supplies electrical power to a well tool interconnected in a tubular string. The power source includes a voltaic cell.

23 Claims, 2 Drawing Sheets

DOWNHOLE ELECTRICAL POWER SYSTEM

CROSS-REFERENCE TO RELATED APPLICATION

The present application claims the benefit under 35 USC §119 of the filing date of PCT Application No. PCT/US01/23280, filed Jul. 24, 2001, the disclosure of which is incorporated herein by this reference.

BACKGROUND

The present invention relates generally to equipment utilized in conjunction with subterranean wells and, in an embodiment described herein, more particularly provides a downhole electrical power system.

There are many uses for a downhole electrical power system. These uses include providing power to operate well tools, such as sensors, data storage devices, flow control devices, transmitters, receivers, etc.

Unfortunately, the downhole environment is frequently inhospitable to some types of power systems. For example, batteries typically cannot withstand wellbore temperatures for long.

Other types of power systems generate electrical power from fluid flow in a well. For example, turbines have been used to drive generators in order to produce electrical power downhole. However, these power systems cannot provide electrical power when the fluid flow ceases.

Therefore, it may be seen that a need exists for an improved downhole electrical power system. Preferably, the improved downhole electrical power system will be able to withstand the downhole environment and will not rely on fluid flow to generate its electrical power.

SUMMARY

In carrying out the principles of the present invention, in accordance with an embodiment thereof, a downhole electrical power system is provided which satisfies the above need in the art. The power system utilizes a voltaic cell to provide electrical power to a well tool downhole.

In one aspect of the invention, a downhole electrical power system includes an electrical power-consuming well tool interconnected in a tubular string. A power source provides the well tool with electrical power and includes at least one voltaic cell. The voltaic cell has an electrolyte which may be isolated from well fluid, or the electrolyte may be well fluid.

A first barrier, such as a floating piston, may be used to isolate the electrolyte from the well fluid. An insulating fluid may be disposed between the well fluid and the electrolyte, and another barrier may be used to isolate the insulating fluid from the electrolyte. One or both of these barriers may be permeable to hydrogen gas generated in the voltaic cell. The barriers may transmit fluid pressure, so that the electrolyte is at substantially the same pressure as the well fluid.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
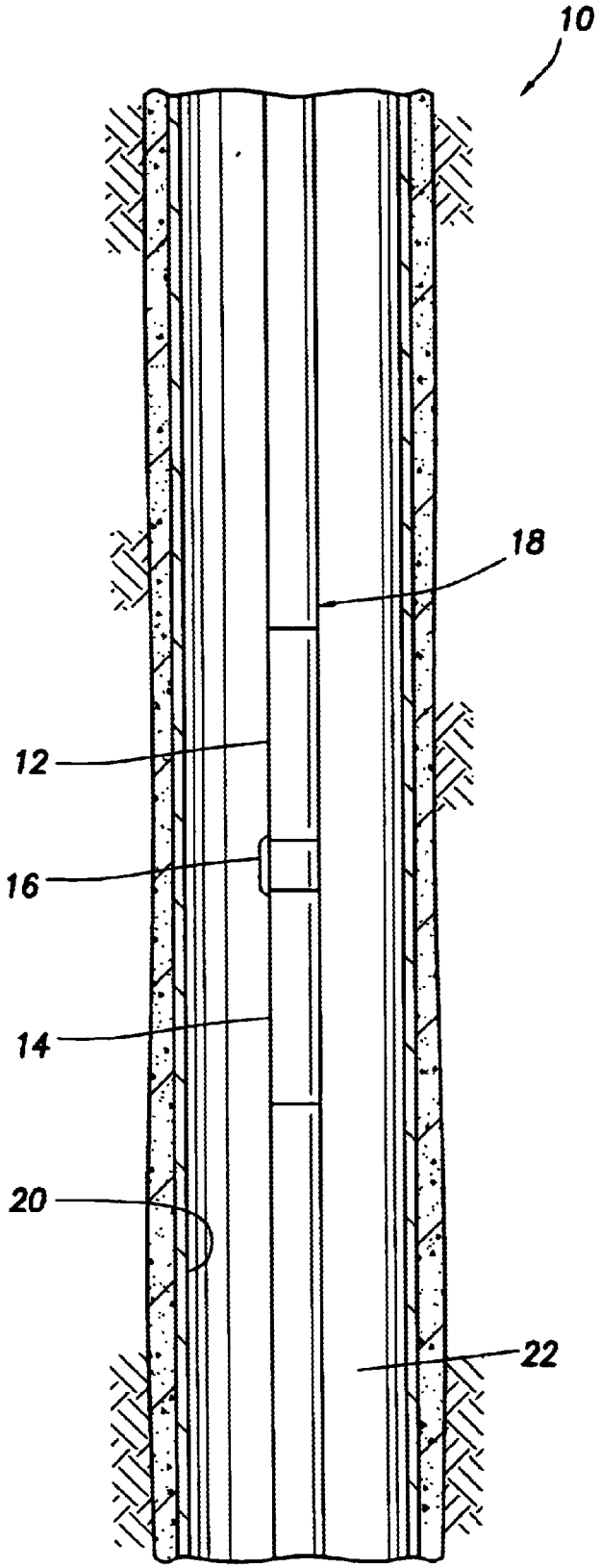
FIG. 1 is a schematic view of a downhole electrical power system embodying principles of the present invention.

Representatively illustrated in FIG. 1 is a downhole electrical power system 10 which embodies principles of the present invention. In the following description of the power system 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

The power system 10 includes an electrical power source 12 and an electrical power-consuming well tool 14. The power source 12 provides electrical power to operate the well tool 14. As depicted in FIG. 1, an external set of conductors 16 are used to conduct electrical power from the power source 12 to the well tool 14, but these conductors could extend internally, or the power source could be connected directly to the well tool, etc.

The well tool 14 could be any type of power-consuming downhole device. For example, the well tool 14 could be a flow control device (such as a valve), a sensor (such as a pressure, temperature or fluid flow sensor), an actuator (such as a solenoid), a data storage device (such as a programmable memory), a communication device (such as a transmitter or a receiver), etc. The power source 12 may also be used to charge a battery or a capacitor, in which case the energy storage device would be the well tool 14.

The well tool 14 and power source 12 are interconnected in, and form a part of, a tubular string 18 positioned in a wellbore 20. An annulus 22 is formed between the tubular string 18 and the wellbore 20. The tubular string 18 may, for example, be a conventional production tubing string having an internal flow passage for production of hydrocarbons from the well, or it could be used for injecting fluid into a subterranean formation through the flow passage, etc.

Note that the power source 12 is depicted in FIG. 1 as being separate and spaced apart from the well tool 14. However, it is to be clearly understood that this is not necessary in keeping with the principles of the present invention. The power source 12 and well tool 14 could be directly connected to each other, they could be combined into the same tool, they could be integrated into another overall tool assembly, etc.

Figure 2:
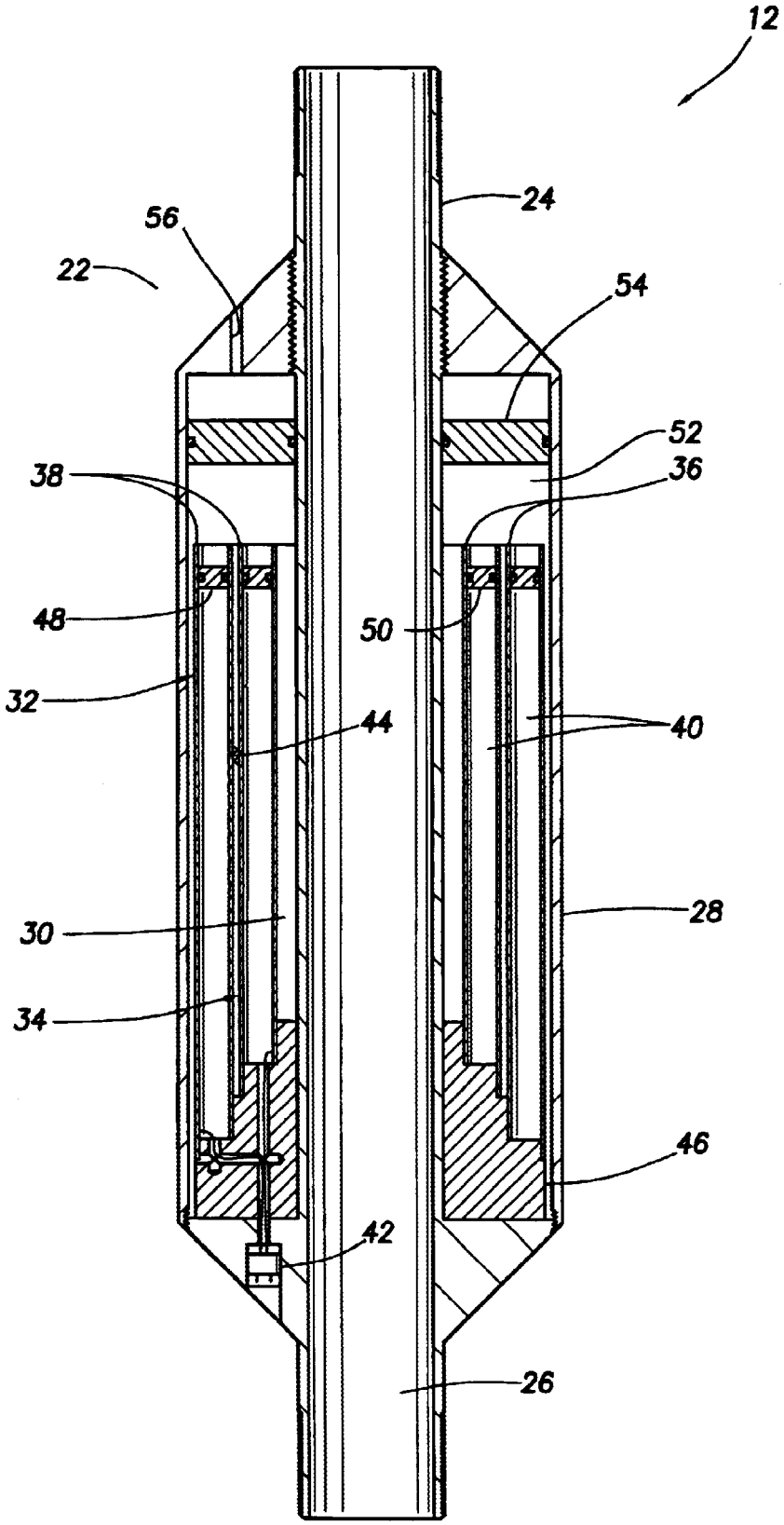
FIG. 2 is a schematic cross-sectional view of an electrical power source of the power system of FIG. 1.

Referring additionally now to FIG. 2, an enlarged cross-sectional view of the power source 12 is representatively illustrated. The power source 12 includes a generally tubular inner housing 24 having a flow passage 26 formed therethrough. The inner housing 24 is threaded at each end for interconnection in the tubular string 18, so that the flow passage 26 communicates with the interior flow passage of the tubular string.

A generally tubular outer housing 28 outwardly surrounds the inner housing 24, thereby forming an annular chamber 30 therebetween. Two voltaic cells 32, 34 are positioned within the chamber 30. The cells 32, 34 are generally annular-shaped, with the outer cell outwardly surrounding the inner cell, and the inner cell outwardly surrounding the flow passage 26. However, it is to be clearly understood that the cells 32, 34 could be otherwise shaped and otherwise positioned, without departing from the principles of the present invention.

Each of the cells 32, 34 includes an annular-shaped anode 36 and an annular-shaped cathode 38. An electrolytic fluid 40 is contained between the anode 36 and cathode 38 of each of the cells 32, 34. Preferably, the anodes 36 are made of a magnesium material, the cathodes 38 are made of a copper or steel material, and the electrolyte 40 is a sodium chloride and water solution. However, other materials may be used. For example, the anodes 36 may comprise an alloy of magnesium and zinc, the cathodes 38 may comprise a silver material or an alloy, and the electrolyte 40 may be another aqueous solution or suspension, such as another salt solution, fresh water, use of a clay backfill, etc.

Using the preferred materials for the anodes 36, cathodes 38 and electrolyte 40, each of the cells 32, 34 should produce approximately 0.7 volts. The cells 32, 34 may be electrically connected in series to produce 1.4 volts (i.e., by connecting the anode 36 of one of the cells to the cathode 38 of the other cell).

As depicted in FIG. 2, one of the anodes 36 and one of the cathodes 38 are connected to a connector 42 for conducting electrical power to the well tool 14 via the conductors 16 described above. The other anode 36 and cathode 38 are connected to each other using a conductor 44, so that the cells 32, 34 are wired in series. Of course, the cells 32, 34 could be wired in parallel, could be connected to separate well tools, or could be connected in any other manner, without departing from the principles of the present invention.

The anodes 36 and cathodes 38 are secured in the chamber 30 by an insulator 46, which also prevents escape of the electrolyte 40 from between the respective anodes and cathodes at the lower ends of the cells 32, 34. If the inner and/or outer housings 24, 28 are made of a nonconducting material, the insulator 46 may be unnecessary. However, electrical communication between the electrolyte 40 in the cells 32, 34 should be prevented.

Escape of the electrolyte 40 from the upper ends of the cells 32, 34 is prevented by annular-shaped electrically insulative floating pistons 48, 50. The pistons 48, 50 permit pressure transfer between the electrolyte 40 and an insulating fluid 52 in the chamber 30 surrounding the cells 32, 34. The fluid 52 may be any type of insulating fluid, such as silicone, etc.

In each of the voltaic cells 32, 34, hydrogen gas is generated at the cathode 38 due to the chemical reaction which produces electricity in the cell. The pistons 48, 50 are made of a material, such as Teflon® or an elastomer, which is gas-permeable, or at least permeable to hydrogen gas. In this way, the hydrogen gas is permitted to escape from the cells 32, 34, rather than accumulate therein.

However, it is to be understood that it is not necessary in keeping with the principles of the present invention for hydrogen gas to be generated at the cathode 38. For example, the salt $CuSO_4$ could be reduced at the cathode 38 ($Cu^{+2}+2e^{-}\rightarrow Cu^{0}$) with no production of hydrogen gas.

Note that the pistons 48, 50 may be some other type of barrier. For example, the pistons 48, 50 could instead be membranes which flex to transmit pressure thereacross, and which are also made of a gas-permeable material to permit escape of the hydrogen gas from the cells 32, 34. Thus, any type of barrier may be used, without departing from the principles of the present invention.

The insulating fluid 52 is isolated from well fluid in the annulus 22 by an annular-shaped floating piston 54 positioned in the chamber 30. The piston 54 transmits pressure between the well fluid in the annulus 22 and the insulating fluid 52 in the chamber 30. In this way, the insulating fluid 52 and electrolytes 40 (via the floating pistons 48, 50) are at substantially the same pressure as the well fluid in the annulus 22, so that the outer housing 28 is pressure balanced.

Of course, as with the pistons 48, 50 described above, any type of barrier may be used in place of the piston 54. For example, a flexible membrane may be used to isolate the well fluid from the insulating fluid 52 while permitting pressure transmission therebetween. The piston 54 may also be hydrogen gas-permeable.

Pressure in the well fluid in the annulus 22 is communicated to the chamber 30 via an opening 56 formed through the outer housing 28. However, it is to be understood that the chamber 30 could be pressurized from the flow passage 26. That is, the opening 56 could provide fluid communication between the chamber 30 and the flow passage 26, instead of between the chamber and the annulus 22, in which case the insulating fluid 52 and electrolytes 40 would be at substantially the same pressure as the well fluid in the flow passage 26. In that case, the inner housing 24 would be pressure balanced opposite the chamber 30.

It should be clearly understood that it is not necessary for either of the inner and outer housings 24, 28 to be pressure balanced, or for the insulating fluid 52 and electrolytes 40 to be at substantially the same pressure as well fluid proximate the power source 12. The chamber 30 could instead be completely sealed from the well fluid pressure. For example, the chamber 30 could be at a reduced pressure relative to the well fluid pressure.

In an alternate embodiment of the power source 12, the well fluid in the annulus 22 or flow passage 26 could serve as the electrolyte 40. For example, brine water is commonly used as a well fluid. Brine water is a salt solution and would function as the electrolyte 40.

If well fluid in the annulus 22 is used as the electrolyte 40, then the opening 56 would extend between the annulus and the chamber 30 as shown in FIG. 2. If well fluid in the flow passage 26 is used as the electrolyte 40, then the opening would instead extend between the flow passage and the chamber 30. In either case, the floating pistons 54, 48, 50 would not be used to isolate the well fluid from the electrolyte 40.

Of course, a person skilled in the art would, upon a careful consideration of the above description of representative embodiments of the invention, readily appreciate that many modifications, additions, substitutions, deletions, and other changes may be made to the specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A downhole electrical power system, comprising:

an electrical power-consuming well tool interconnected in a tubular string; and a power source providing the well tool with electrical power, the power source including at least one voltaic cell having an anode and a cathode, each of the anode and cathode being exposed to an electrolyte, and the electrolyte being isolated from well fluid proximate the power source by at least one pressure transmitting fluid barrier.

2. A downhole electrical power system, comprising:

an electrical power-consuming well tool interconnected in a tubular string; and a power source providing the well tool with electrical power, the power source including at least one voltaic cell having an anode and a cathode, each of the anode and cathode being exposed to an electrolyte, and wherein the electrolyte is a salt solution.

3. A downhole electrical power system, comprising:

an electrical power-consuming well tool interconnected in a tubular string; and a power source providing the well tool with electrical power, the power source including at least one voltaic cell having an anode and a cathode, each of the anode and cathode being exposed to an electrolyte, and wherein the cathode comprises a material which is a selected one of copper and silver.

4. A downhole electrical power system, comprising:

an electrical power-consuming well tool interconnected in a tubular string; and a power source providing the well tool with electrical power, the power source including at least one voltaic cell having an anode and a cathode, each of the anode and cathode being exposed to an electrolyte, and wherein the anode comprises a material which is a selected one of aluminum and an alloy of zinc and magnesium.

5. A downhole electrical power system, comprising:

an electrical power-consuming well tool interconnected in a tubular string; and a power source providing the well tool with electrical power, the power source including at least one voltaic cell having an anode and a cathode, each of the anode and cathode being exposed to an electrolyte, and wherein the voltaic cell is at least partially enclosed by a gas-permeable barrier.

6. The power system according to claim 5, wherein the gas-permeable barrier is permeable to hydrogen gas.

7. The power system according to claim 5, wherein the gas-permeable barrier is a floating piston.

8. A downhole electrical power system, comprising:

an electrical power-consuming well tool interconnected in a tubular string; and a power source providing the well tool with electrical power, the power source including at least one voltaic cell having an anode and a cathode, each of the anode and cathode being exposed to an electrolyte, the electrolyte being maintained at a pressure substantially equal to well fluid pressure proximate the power system, and wherein a barrier isolates the electrolyte from the wellbore fluid, while transmitting pressure between the well fluid and the electrolyte.

9. A downhole electrical power system, comprising:

an electrical power-consuming well tool interconnected in a tubular string; and a power source providing the well tool with electrical power, the power source including at least one voltaic cell having an anode and a cathode, each of the anode and cathode being exposed to an electrolyte, the electrolyte being maintained at a pressure substantially equal to well fluid pressure proximate the power system, and an electrically insulating fluid being disposed between the well fluid and the electrolyte.

10. The power system according to claim 9, wherein an electrically insulating barrier isolates the electrolyte from the insulating fluid, while transmitting pressure between the insulating fluid and the electrolyte.

11. The power system according to claim 10, wherein the insulating barrier is permeable to hydrogen gas generated in the voltaic cell.

12. A downhole electrical power system, comprising:

an inner housing having a flow passage formed therethrough, the inner housing being interconnected to a tubular string in a well, so that the flow passage is in communication with the interior of the tubular string;

an outer housing at least partially spaced apart from the inner housing, so that a chamber is formed therebetween; and at least one voltaic cell disposed in the chamber, the voltaic cell supplying electrical power to operate a well tool.

13. The power system according to claim 12, wherein the voltaic cell is isolated from well fluid by a first barrier which permits pressure transfer between the well fluid and the voltaic cell.

14. The power system according to claim 13, further comprising an insulating fluid disposed between the well fluid and the voltaic cell.

15. The power system according to claim 14, wherein the first barrier isolates the well fluid from the insulating fluid, and a second barrier isolates the insulating fluid from an electrolyte of the voltaic cell.

16. The power system according to claim 15, wherein the second barrier is electrically insulative.

17. The power system according to claim 15, wherein the second barrier permits pressure transfer between the insulating fluid and the electrolyte.

18. The power system according to claim 17, wherein the second barrier is permeable to hydrogen generated in the voltaic cell.

19. The power system according to claim 12, wherein there are multiple ones of the voltaic cells, the voltaic cells being electrically connected to each other.

20. The power system according to claim 19, wherein the voltaic cells are connected in series.

21. The power system according to claim 19, wherein a first one of the voltaic cells is positioned within a second one of the voltaic cells.

22. The power system according to claim 21, wherein the second voltaic cell is annular-shaped and surrounds the first voltaic cell.

23. The power system according to claim 22, wherein the first voltaic cell is annular-shaped and surrounds the flow passage.

* * * * *

UNITED STATES PATENT AND TRADEMARK OFFICE

CERTIFICATE OF CORRECTION

PATENT NO. : 6,672,382 B2
APPLICATION NO. : 10/142134
DATED : January 6, 2004
INVENTOR(S) : Roger Schultz It is certified that error appears in the above-identified patent and that said Letters Patent is hereby corrected as shown below:

Title Pg, Insert Foreign Appl Priority Data to read:
--(30) Foreign Application Priority Data PCT/US01/23280 July 24, 2001--.

Signed and Sealed this

Twenty-first Day of April, 2009

John Doll

JOHN DOLL
*Acting Director of the United States Patent and Trademark Office*